US010543687B2

(12) United States Patent
Hussain et al.

(10) Patent No.: US 10,543,687 B2
(45) Date of Patent: Jan. 28, 2020

(54) ULTRASONIC MAINTENANCE CAP

(71) Applicant: TONEJET LIMITED, Melbourn, Royston (GB)

(72) Inventors: Fred (Fahad) Hussain, Cambridge (GB); Phillip Zachary Green, Cambridge (GB); Ian Philip Butler Ingham, Cambridge (GB); Nigel Paul Brooks, Cambridge (GB)

(73) Assignee: TONEJET LIMITED, Melbourn, Royston (GB)

( * ) Notice: Subject to any disclaimer, the term of this patent is extended or adjusted under 35 U.S.C. 154(b) by 0 days.

(21) Appl. No.: 15/768,606

(22) PCT Filed: Oct. 14, 2016

(86) PCT No.: PCT/EP2016/074816
§ 371 (c)(1),
(2) Date: Apr. 16, 2018

(87) PCT Pub. No.: WO2017/064310
PCT Pub. Date: Apr. 20, 2017

(65) Prior Publication Data

US 2018/0304634 A1 Oct. 25, 2018

(30) Foreign Application Priority Data

Oct. 16, 2015 (EP) ..... 15190271

(51) Int. Cl.
*B41J 2/165* (2006.01)

(52) U.S. Cl.
CPC ..... *B41J 2/16517* (2013.01); *B41J 2/16505* (2013.01); *B41J 2002/16567* (2013.01)

(58) Field of Classification Search
CPC ..... B41J 2/16517; B41J 2/16505; B41J 2/16552; B41J 2/17566; B41J 2002/16567
See application file for complete search history.

(56) References Cited

U.S. PATENT DOCUMENTS 4,600,928 A 7/1986 Braun et al.
5,574,485 A 11/1996 Anderson et al.
(Continued)

FOREIGN PATENT DOCUMENTS

EP 2708361 3/2014

OTHER PUBLICATIONS ip.com search (Year: 2019).*
International Search Report and Written Opinion in Application No. PCT/EP2016/074816 dated Jan. 20, 2017, 11 pages.

*Primary Examiner* — Lisa Solomon
(74) *Attorney, Agent, or Firm* — Anthony M. Petro; Kowert, Hood, Munyon, Rankin & Goetzel, P.C.

(57) ABSTRACT

A maintenance cap is provided for in-situ attachment to a printhead of printing apparatus. The maintenance cap comprises a housing defining at least one chamber for receiving a liquid. An opening in the housing provides a path for the liquid to pass from the chamber into a portion of the printhead when the maintenance cap is engaged with the printhead. The maintenance cap also includes a seal disposed around the opening for engagement with the printhead. A transducer coupled to the housing is used to generate ultrasound acoustic waves in the liquid contained in the chamber and printhead so as to clean the printhead.

20 Claims, 13 Drawing Sheets

(56) References Cited

U.S. PATENT DOCUMENTS

| | | | |
|---|---|---|---|
| 6,183,057 | B1 | 2/2001 | Sharma et al. |
| 6,267,464 | B1 | 7/2001 | Furlani et al. |
| 6,283,575 | B1 | 9/2001 | Hawkins et al. |
| 2006/0274128 | A1 | 12/2006 | Tsukada et al. |

* cited by examiner

Figure 3 Sectional view in XZ of cleaning fluid manifold
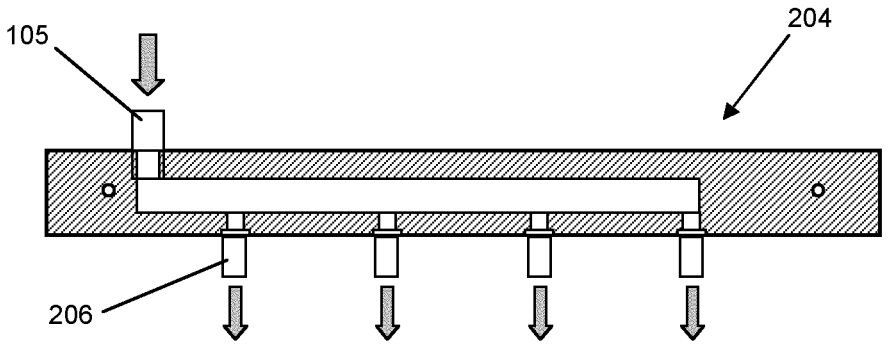
Figure 4 Sectional view in YZ of printhead
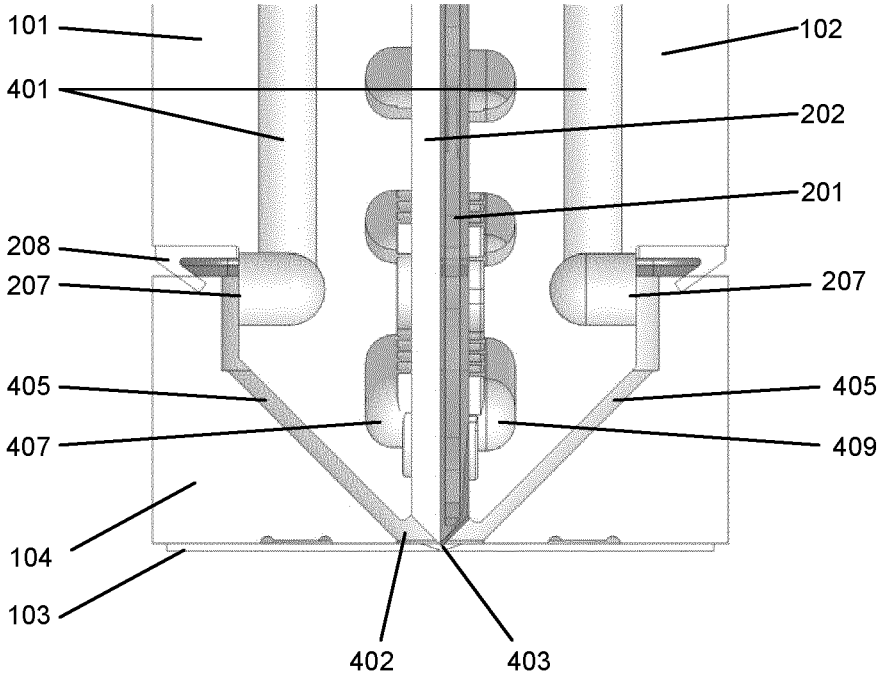

ULTRASONIC MAINTENANCE CAP

FIELD OF INVENTION

The present invention relates to a printhead maintenance cap for cleaning the printhead of a printing apparatus using ultrasound waves. Also provided is a method of using the printhead maintenance cap.

BACKGROUND TO THE INVENTION

The type of electrostatic printhead described in WO 93/11866 is well known. Electrostatic printheads of this type eject charged solid particles dispersed in a chemically inert, insulating carrier liquid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates a force on the charged particles that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the location and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particles so that the direction of the electrophoretic force is away from the electrodes and towards the substrate. Further, the overall geometry of the printhead structure and the position of the electrodes are designed such that concentration and ejection occur at a highly localised region around the locations of the protrusions.

The ink is arranged to flow past the ejection location continuously in order to replenish the particles that have been ejected. To enable this flow the ink must be of a low viscosity, typically a few centipoises. The material that is ejected is more viscous because of the higher concentration of particles due to selective ejection of the charged particles; as a result, the technology can be used to print onto non-absorbing substrates because the material will spread less upon impact.

Various printhead designs have been described in the prior art, such as those in WO 93/11866, WO 97/27058, WO 97/27056, WO 98/32609, WO 98/42515, WO 01/30576 and WO 03/101741.

A printhead as described above may, through sustained use, eventually build up deposits of unwanted matter which must be removed. Occasionally, ink particles may form solid deposits in the region of the ejection locations of the printhead and airborne dust particles may settle in the ejection region, including the ejection locations and the intermediate electrode.

A previously known method of removing unwanted matter from the printhead is to pass a cleaning (or rinse) liquid through the ejection region of the printhead in order to expel any debris. The cleaning liquid that is used in such methods is primarily composed of the ink carrier liquid, in which the ink particles are necessarily insoluble. To remove deposits of ink particles that have dried onto any surfaces of the printhead, it is preferable to combine such a method with a mechanical "scrubbing" process. Typically, the mechanical "scrubbing" process involves combining the cleaning liquid with air in order to agitate the flow of the liquid and thereby dislodge ink deposits. In some cases, the effectiveness of this "scrubbing" process has been found to be inadequate at completely removing dried on ink deposits.

Attempts have been made to perform the above method using a cleaning liquid capable of dissolving the ink deposits. However, such liquids were incompatible with the inks used in printing. As it is inevitable that small quantities of cleaning liquid remaining in the printheads after cleaning will mix with the printing ink, the liquids must be compatible with each other.

Other previously known methods that can successfully remove all unwanted matter from a printhead have required manual intervention, either to remove the front face of the printhead to access the ejection region of the printhead, or to remove the printhead from the printing machine such that further cleaning can take place. A wider range of cleaning methods, such as the use of solvent, chemical or ultrasonic baths, may then be applied to the printhead. Any solvent residue can be carefully removed from the printhead before it is reinserted into the printing machine.

The removal, cleaning and subsequent reinsertion of the printhead and/or its front face is a time consuming process that requires significant skill to perform. This necessitates undesirable periods of downtime for the printing machine and increases the risk of damage to elements of the printhead during removal, cleaning and reattachment.

U.S. Pat. No. 6,183,057 B1 teaches an apparatus for cleaning a printer in which a cleaning cap is provided for engagement with the face of a printhead. In use, a continuous flow of a cleaning fluid is passed over the face of a printhead such that viscous forces in the fluid dislodge and remove debris on the printhead. An ultrasonic transducer is provided in order to induce pressure waves having frequencies of approximately 17,000 kHz in the liquid.

Such an apparatus, however, is not suitable for use with printheads comprising ejection regions located behind an intermediate electrode. The constant flow of fluid over the face of the printhead prevents deep penetration of the fluid into a region of the printhead comprising the ejection locations, thus limiting the cleaning action to the exterior of the printhead. The flow of the fluid also results in turbulence which causes an attenuation of the ultrasonic pressure waves when propagating towards the printhead.

Therefore there is a need to provide an improved approach for cleaning a printhead which allows thorough removal of unwanted matter whilst avoiding the problems encountered using known techniques.

SUMMARY OF INVENTION

According to a first aspect of the present invention, there is provided a maintenance cap for attachment to at least part of a printhead, the maintenance cap comprising: a housing defining at least one chamber for receiving a liquid, the housing comprising: at least one opening providing a path for the liquid to pass from the chamber into a portion of the printhead when the maintenance cap is engaged with the printhead; and a seal disposed around the at least one opening for engagement with the printhead. The maintenance cap further comprises at least one transducer coupled to the housing for generating ultrasound acoustic waves in the liquid contained in the chamber and printhead, thereby cleaning the printhead. The at least one transducer is configured to generate acoustic waves having frequencies between 20 kHz and 100 kHz.

The above maintenance cap allows ultrasonic energy to be provided to the ejection region of a printhead while the printhead remains in-situ. This is advantageous over known techniques of cleaning a printhead for many reasons. The invention is particularly beneficial for the cleaning of printheads of electrostatic inkjet printers.

The maintenance cap is able to form a seal between itself and the printhead and can thereby define a cleaning volume comprising the chamber of the maintenance cap, an internal volume of the printhead and a small sealing volume between the maintenance cap and the printhead (if such a sealing volume is additional to that of the chamber of the maintenance cap). By forming a liquid tight region comprising the maintenance cap and an internal volume of the printhead, the ejection region of the printhead can be immersed in a cleaning liquid without the printhead needing to be removed from the printing apparatus.

The at least one ultrasonic transducer is able to supply ultrasonic waves that propagate throughout a liquid contained in the cleaning volume, forming cavitation bubbles which act to remove deposits of unwanted matter on the surfaces. The ultrasonic cleaning obviates the need to use solvents which are incompatible with the printing ink of the printhead.

This use of ultrasonic waves having frequencies between 20 kHz and 100 kHz allows the ultrasonic waves to penetrate the slot in the face of the printhead and propagate into the internal volume of the printhead, while providing enough power to remove unwanted matter. Furthermore, the chosen frequency range allows cavitation to occur at power intensities that can be easily achieved with known ultrasonic transducers.

The at least one opening may be elongate and have a length greater than that of an opening in the face of the printhead. This enables the ultrasonic waves to propagate across the entire length of the opening in the printhead and into the internal region of the printhead. This allows a uniform cleaning action to act across the entire ejection region of the printhead.

Whilst various configurations of the seal are contemplated, it is preferred that the seal disposed around the at least one opening is a compliant face-seal for engagement with the face of the printhead. This allows the maintenance cap to be easily brought into engagement with the face of the printhead and typically provides a short channel between maintenance cap and the printhead through which the ultrasonic waves must propagate, thus minimizing attenuation of the wave power between the cap and the ejection region of the printhead.

The at least one transducer is advantageously configured to provide acoustic waves to the chamber at an intensity of between 0.1 and 10 W/cm$^2$, preferably between 1 and 10 W/cm2. The applicant has found that this intensity range allows ultrasonic waves to form cavitation bubbles in the liquid contained in the cleaning volume when driven at frequencies that enable the ultrasonic waves to penetrate the opening in the printhead.

In one embodiment, the at least one transducer has a radiating surface (i.e. an area of contact with the chamber through which ultrasonic energy is transmitted into the chamber) of 12 cm$^2$ that is configured to provide acoustic waves to the chamber with a power of up to 50 W.

The housing may comprise a fluid port for receiving liquid from a liquid supply disposed separately from the maintenance cap. This allows the housing to be filled from a source located away from the maintenance cap while the cap is engaged with a printhead.

The at least one transducer may be coupled to the housing on a surface opposite to the at least one opening. This allows the ultrasonic waves to be directed towards the opening in the housing and, therefore, towards the ejection region of the printhead.

The maintenance cap may comprise two or more transducers arranged in or along a line parallel to the elongate axis of the at least one opening in the housing. This causes ultrasonic energy to be distributed evenly across the array in ejection locations in the printhead.

In principle the maintenance cap may be used with a number of different types of printhead. An example of a suitable printhead is an electrostatic printhead comprising an inner volume in which ejection locations of the printhead are disposed and further comprising a face with an opening slot that provides a path between the inner volume and the outside of the printhead.

Also provided is a system comprising the maintenance cap and further comprising a fill level control device, the fill level control device being in fluid communication with the at least one chamber and configured to control a maximum equilibrium height for the liquid in the at least one chamber and a printhead with which the chamber is engaged. This allows an upper bound to be defined for the cleaning volume, thus defining the exact volume in which the cleaning liquid may be located.

The fill level control device may be configured such that the maximum height of the liquid in the at least one chamber and a printhead with which the chamber is engaged is greater than the height of the opening of the housing. This enables the cleaning volume to extend out of the maintenance cap and into the printhead internal volume, thereby allowing the cleaning liquid to engulf the printhead ejection locations.

The fill level control device may comprise a weir, wherein the height of the top of the weir limits the maximum height of the liquid in the at least one chamber and a printhead with which the chamber is engaged. The use of a weir to limit the maximum height of liquid enables excess liquid to be supplied to the maintenance cap without the maximum fill level being exceeded. This enables a simple filling process that does not require an exact volume of cleaning liquid to be determined and delivered to the maintenance cap.

The housing may define a plurality of chambers, each of which is fluidically isolated from the other chambers; wherein each chamber comprises an opening providing a path for the liquid to pass from the chamber into a portion of a respective printhead when the chamber is engaged with the printhead. This enables the cap to be used with printing modules comprising a number of printheads, which could each use a different respective ink chemistry, for example.

Alternatively a chamber may comprise plural openings that communicate with plural respective printheads when the chamber is engaged with the printheads.

In accordance with a second aspect of the invention there is provided a method of cleaning a printhead. The method comprises: forming a seal between a maintenance cap and a printhead by bringing the maintenance cap into engagement with the printhead; immersing the ejection region of the printhead in a liquid by supplying the liquid into a chamber defined by the maintenance cap; and cleaning the ejection region of the printhead by generating ultrasound acoustic waves having a frequency of between 20 kHz and 100 kHz in the liquid.

This method is advantageous over previous methods of cleaning a printhead as it provides intensive cleaning process to the internal and external components of a printhead without requiring that the printhead be removed from the printing apparatus or the use of solvents of the ink solids.

The step of forming a seal between the maintenance cap and the printhead may define a cleaning volume, wherein the cleaning volume is formed from an interconnected volume comprising the combination of at least a first volume within the maintenance cap chamber and a second volume which is an internal volume within the printhead. This interconnected volume includes any volume present which is defined by a seal between the maintenance cap and the printhead. During the immersing step the cleaning volume is filled with the liquid so as to enable the propagation of the ultrasound waves from their origin to the parts of the printhead to be cleaned. The liquid is typically a cleaning liquid which preferably comprises the same liquid as the carrier liquid for the ink used in the printhead. The use of such a liquid ensures compatibility with the ink should any residue of the cleaning liquid come into contact or become mixed with ink following the cleaning operation and reduces the need for subsequent flushing or drying steps prior to the operation of the printhead.

Preferably, the supply of liquid into the chamber defined by the maintenance cap is stopped at a time when the ejection region of the printhead is immersed in the liquid. By stopping the supply of liquid into the chamber defined by the maintenance cap at a time when the ejection region of the printhead is immersed in the liquid, the liquid is allowed to settle, thereby providing a stable medium through which ultrasonic waves may propagate without suffering from attenuation due to turbulence.

Typically the printhead has an ejection region (for example, including an intermediate electrode and plurality of ejection tips) which faces downward when in use and the maintenance cap may therefore be conveniently engaged with the printhead from below. The maintenance cap may also be used in cases where the printhead has an ejection region that faces downwards and tilted but with the axis of the line of ejectors oriented horizontally.

In the case of printing apparatus with multiple printheads a single maintenance cap may be used to clean multiple printheads simultaneously or independently without the need to change position, particularly if separate chambers are provided for each respective printhead.

As will be appreciated, the method according to the second aspect is preferably performed using a maintenance cap according to the first aspect.

BRIEF DESCRIPTION OF THE FIGURES

Some examples of the invention are now described with reference to the accompanying drawings, in which:

FIG. 3 is a sectional view of a manifold block that directs cleaning/rinse fluids to different parts of the printhead.

FIG. 4 is a sectional view of the printhead showing passages that direct cleaning fluids to the tip region of the printhead.

DETAILED DESCRIPTION OF THE INVENTION

Figure 5:
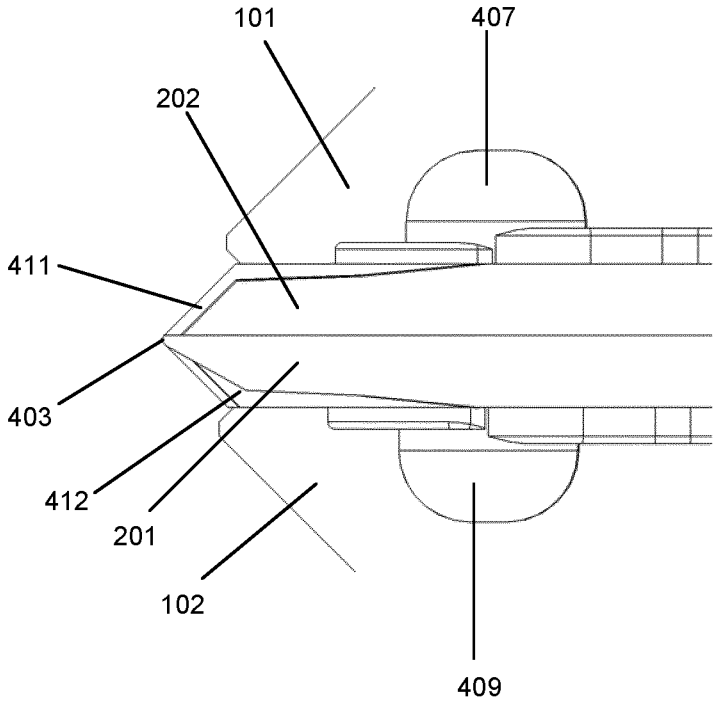
FIG. 5 is a detailed cross-sectional view of the ejection region of the printhead illustrated in FIG. 1.
Figure 6:
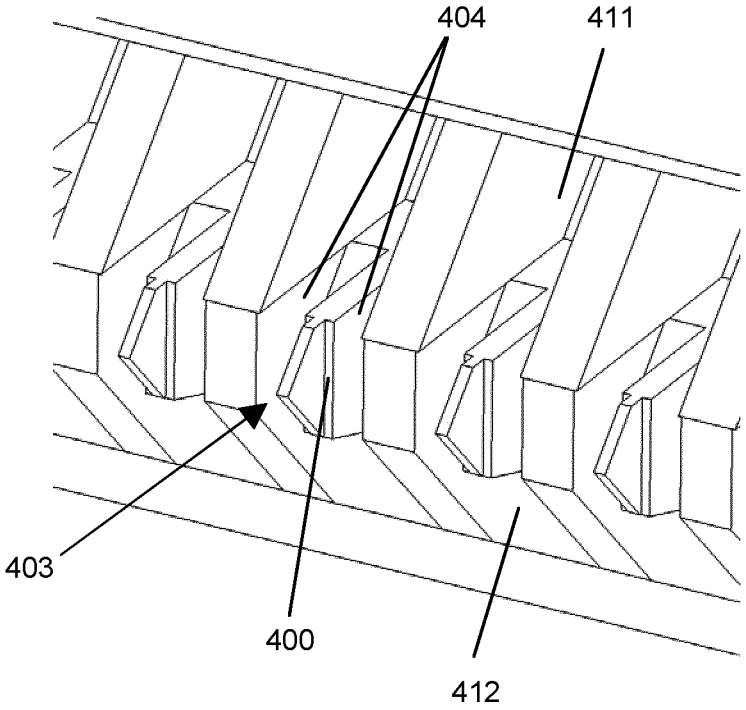
FIG. 6 is a three-dimensional close-up of the ejection region of the printhead illustrated in FIG. 1.
Figure 7:
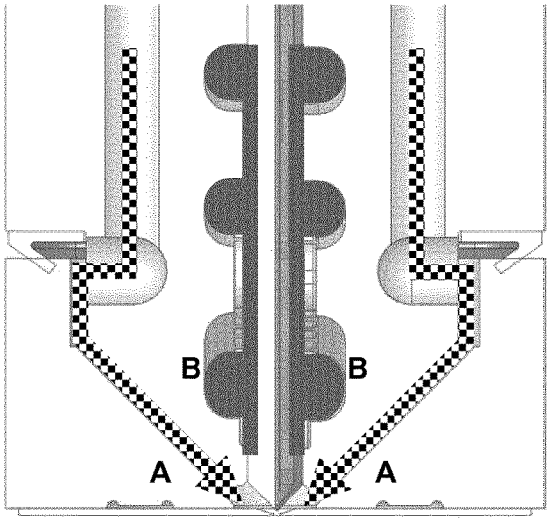
FIG. 7 is the same view as FIG. 4, but with the fluid flow paths indicated.

In order to facilitate an understanding of the invention, we firstly discuss the structure of a known printhead in association with FIGS. 1 to 6, followed by a discussion of the use of a known cleaning operation in association with FIG. 7.

Figure 1:
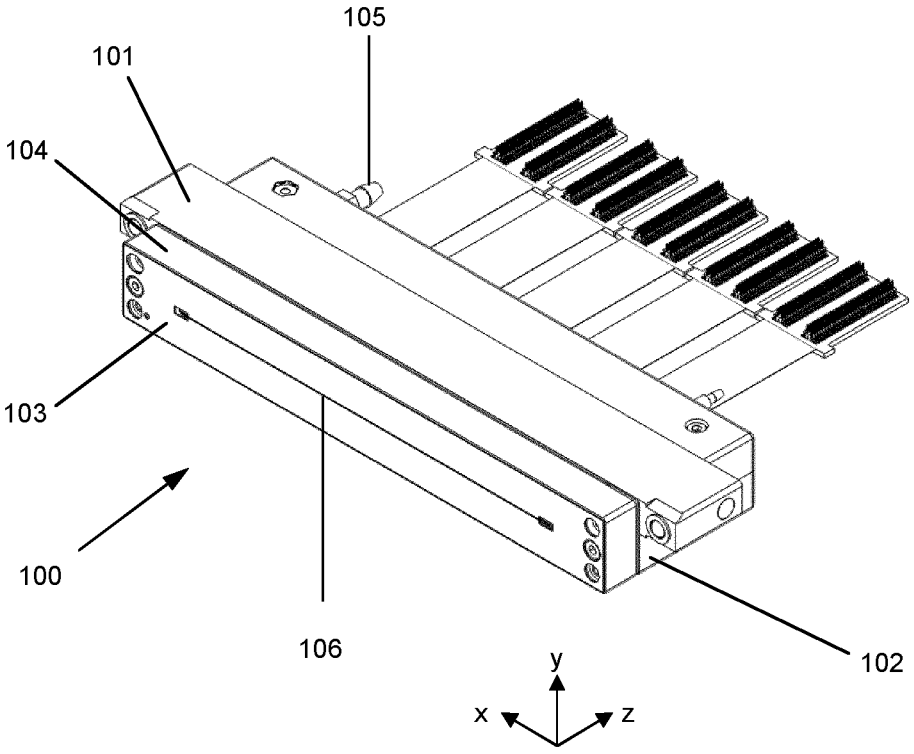
FIG. 1 is a perspective view of a printhead that is suitable for use with the present invention.
Figure 2:
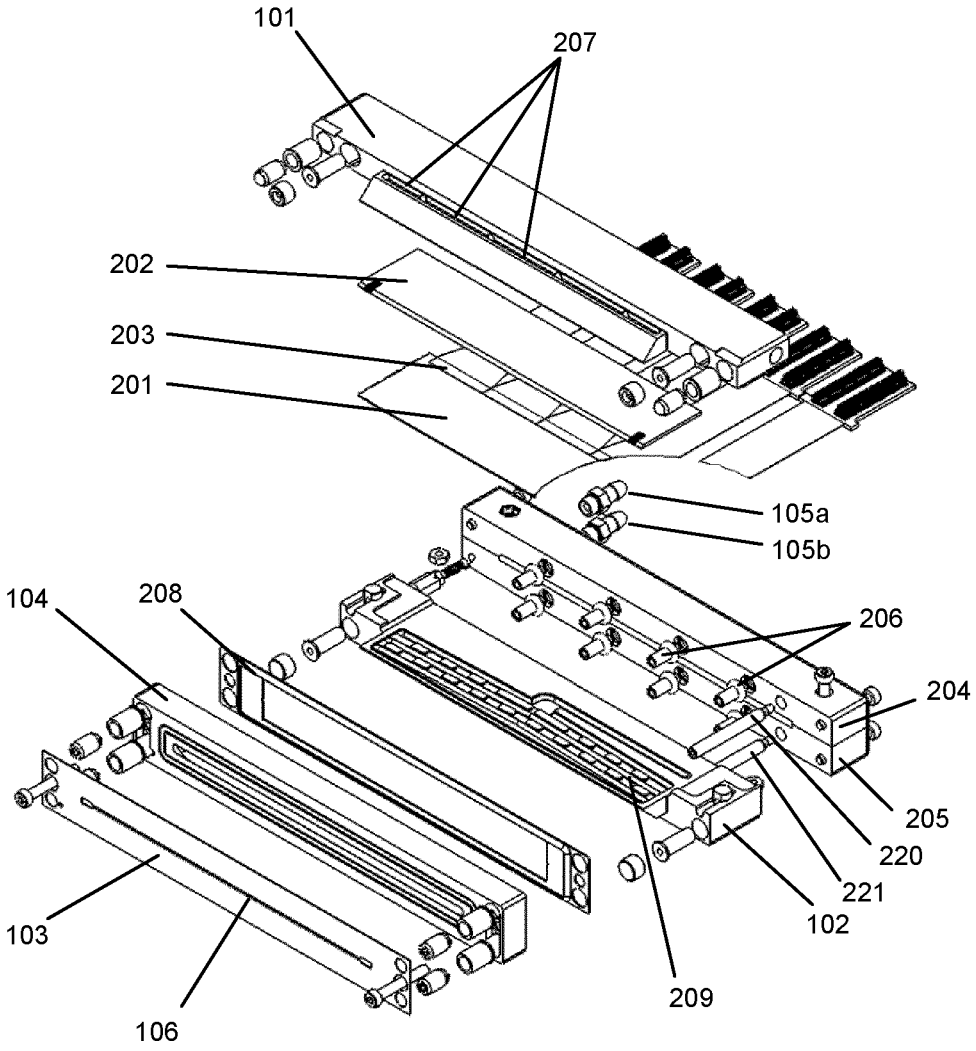
FIG. 2 is an exploded view of the printhead illustrated in FIG. 1.

FIG. 1 shows an electrostatic printhead of the type described in WO 93/11866, the operating principles of which were discussed in the background section. The printhead 100 for use with the present invention comprises a two-part main body consisting of an inflow block 101 and an outflow block 102, between which are located a prism 202 and a central tile 201, the latter having the ejector array formed along its front edge (FIG. 2). At the front of the printhead, an intermediate electrode plate 103 is mounted on to a datum plate 104, which in turn is mounted onto the main body of the printhead. The intermediate electrode 103 comprises a slot 106, which is typically between 0.2 mm and 0.3 mm wide, through which ink is ejected in use. The intermediate electrode 103 typically forms the front face of the printhead 100. A gasket 208 is provided between the datum plate 104 and the inflow and outflow blocks.

Referring to FIGS. 2, 3, 4, 5 and 6, the main body of the printhead comprises the inflow block 101 and the outflow block 102, sandwiched between which are the prism 202 and the central tile 201. The central tile 201 has an array of ejection locations 403 along its front edge and an array of electrical connections 203 along its rear edge. Each ejection location 403 comprises an upstand 400 with which an ink meniscus interacts (in a manner well known in the art). On either side of the upstand 400 is an ink channel 404 that carries ink past both sides of the ejection upstand 400. In use, a proportion of ink is ejected from the ejection locations 403 to form, for example, the pixels of a printed image. The ejection of ink from the ejection locations 403 by the application of electrostatic forces is well understood by those of skill in the art and will not be described further herein.

The prism 202 comprises a series of narrow channels 411, corresponding to each of the individual ejection locations 403 in the central tile 201. The ink channels of each ejection location 403 are in fluid communication with the respective channels of the prism 202, which are, in turn, in fluid communication with a front portion 407 of the inlet manifold formed in the inflow block 101 (said inlet manifold being formed on the underside of the inflow block 101 as it is presented in FIG. 2 and thus not shown in that view). On the other side of the ejection locations 403, the ink channels 404 merge into a single channel 412 per ejection location 403 and extend away from the ejection locations 403 on the underside (as drawn in FIG. 5) of the central tile 201 to a point where they become in fluid communication with a front portion 409 of the outlet manifold 209 formed in the outflow block 102.

The ink is supplied to the ejection locations 403 by means of an ink supply tube 220 in the printhead 100 which feeds ink into the inlet manifold within the inflow block 101. The ink passes through the inlet manifold and from there through the channels 411 of the prism 202 to the ejection locations 403 on the central tile 201. Surplus ink that is not ejected from the ejection locations 403 in use then flows along the ink channels 412 of the central tile 201 into the outlet manifold 209 in the outflow block 102. The ink leaves the outlet manifold 209 through an ink return tube 221 and passes back into the bulk ink supply.

The channels 411 of the prism 202 which are connected to the individual ejection locations 403 are supplied with ink from the inlet manifold at a precise pressure in order to maintain accurately controlled ejection characteristics at the individual ejection locations 403. The pressure of the ink supplied to each individual channel 411 of the prism 202 by the ink inlet manifold is equal across the entire width of the array of ejection locations 403 of the printhead 100. Similarly, the pressure of the ink returning from each individual channel 412 of the central tile 201 to the outlet manifold 209 is equal across the entire width of the array of ejection locations 403 and precisely controlled at the outlet, because the inlet and the outlet ink pressures together determine the quiescent pressure of ink at each ejection location 403.

The printhead 100 is also provided with an upper 204 and a lower 205 cleaning fluid manifold. The upper and lower cleaning fluid manifolds have respective inlets 105*a*, 105*b* through which rinse/cleaning liquid can be supplied to the printhead 100. The inflow 101 and outflow 102 blocks are both provided with cleaning fluid passages 401. The passages in the inflow block 101 are in fluid communication with upper cleaning fluid manifold 204 and those passages in the outflow block 102 are in fluid communication with the lower cleaning fluid manifold 205. Fluid connectors 206 link the cleaning fluid manifolds to the respective cleaning fluid passages.

The cleaning fluid passages 401 within the inflow and outflow blocks end at cleaning fluid outlets 207. The pathway to the ejection locations 403 continues along enclosed spaces 405 defined by the V-shaped cavity 402 in the datum plate 104 and the outer surfaces of the inflow 101 and outflow 102 blocks, until the point at which the ejection locations 403 themselves lie within the cavity 402.

The two sides of the V-shaped cavity are, in this example, at 90 degrees to each other.

As can be seen in FIG. 7, arrows A show the fluid pathways taken by the rinse/cleaning liquid and/or air during part of a cleaning operation of the printhead. Regions B show the pathways taken by the ink through the inlet and outlet manifolds and along ink channels 411 and 412. During normal operation a flow of ink exists around the locations 403 from the inlet side (inlet block 201) to the outlet side (outflow block 202). In normal use, there is no flow of cleaning liquid—indeed no cleaning liquid is present in the printhead. However, during a cleaning operation, ink flow is stopped and the ink is preferably withdrawn from the printhead, by lowering the pressures at the inlet 220 and outlet 221, to avoid substantial mixing of ink with cleaning liquid. Cleaning liquid is supplied through passages 401 and into cavity 402 to flush the internal surfaces of the cavity comprising the ejection tips and the intermediate electrode. When cleaning is complete, the printhead can be re-primed by moving the ink back to the ejection locations 403 and resuming a constant flow around the ejection locations 403 from the inflow to the outflow side of the printhead.

The above described cleaning operations are limited in that unwanted matter on the printheads, such as dried ink deposits, is subjected only to the flow of cleaning liquid with no more aggressive cleaning processes being applied.

The cleaning fluid passages 401 are also used in part of the cleaning operation described below to vent the cavity 402 when cleaning liquid is supplied into or drained from the maintenance cap, which is sealed to the front face of the printhead. This is accomplished by use of a combination of control valves which connects the inlets 105*a* and 105*b* to a supply of cleaning liquid, a supply of compressed air, or to atmosphere.

When the printhead 100 is oriented such that its ejection locations 403 are facing downwards, the intermediate electrode 103 forms the lower surface of an internal volume of the printhead 100. The internal volume of the printhead comprises an open cavity into which the ejection locations 403 protrude and is bounded from below by the intermediate electrode 103 and on its sides by the datum plate 104 to form a basin. The internal volume may be filled with a quantity of liquid, which, if prevented from flowing through the opening 106 in the intermediate electrode 103, is held within the internal volume. In such a case, the ejection locations 403 may be partially or fully submerged depending on the height of the liquid. When used with the maintenance cap apparatus described below, the internal volume is connected to a further chamber via the opening 106 in the intermediate electrode 103. Liquid in the internal volume is supported in hydrostatic equilibrium with liquid in the chamber below and, thus, prevented from draining through the opening 106 in the intermediate electrode 103. The printhead and maintenance cap may also be oriented such that the ejection locations of the printhead are facing downwards and tilted rather than purely downwards, with the line of ejectors oriented in a horizontal line. In this case the same principle applies to the filling of the internal volume and the liquid is similarly prevented from draining through the opening 106 in the intermediate electrode 103.

Figure 8:
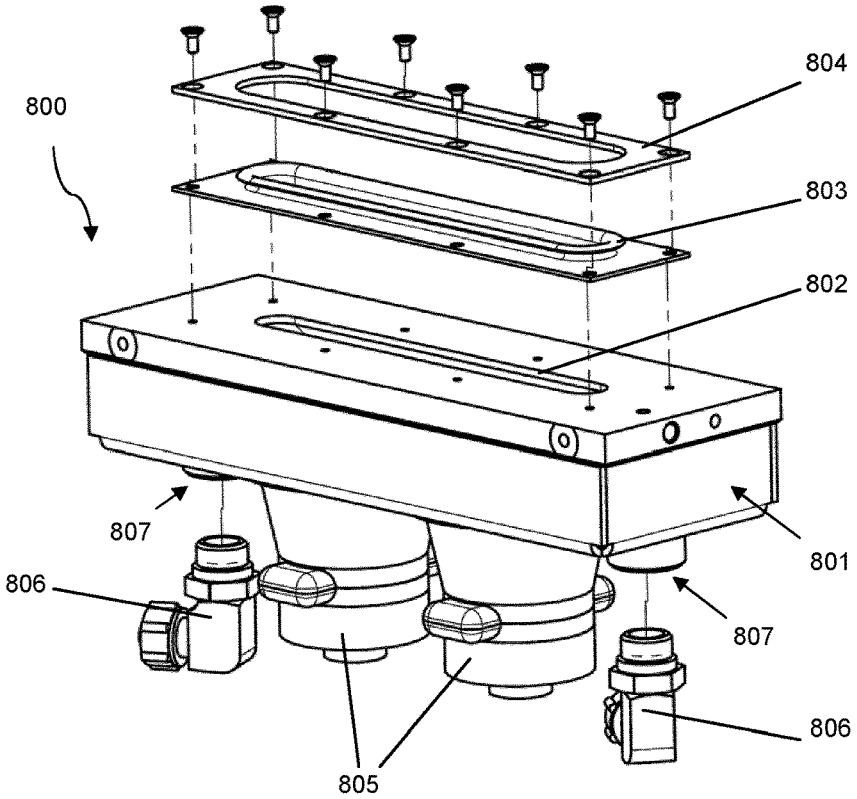
FIG. 8 is an exploded view of an ultrasonic maintenance cap according to an example of the invention.

The cleaning maintenance cap 800 of FIG. 8 provides the apparatus for a further in-situ cleaning process in which ultrasonic energy is used to aggressively remove unwanted matter from the printhead 100. In use, the maintenance cap 800 may be engaged with a printhead 100 to form a seal between the housing 801 and the printhead 100 (see FIG. 9). The housing 801 may then be filled with cleaning liquid 1001 (see FIG. 10) until the level of the cleaning liquid 1001 reaches a sufficient height 1002 so as to engulf elements of the printhead 100 including the ejection locations 403 and the intermediate electrode 103. Ultrasonic transducers 805, which are coupled to the housing 801, may then be used to transmit power to the cleaning liquid 1001 in the form of ultrasonic acoustic waves. The ultrasonic waves cause cavitation of the cleaning liquid 1001 which creates shockwaves around surfaces of the printhead ejection region, such as the ejection locations 403 and intermediate electrode 103. The shockwaves caused by the cavitation of the cleaning liquid 1001 act to break up deposits of unwanted matter and thereby clean the printhead 100. The forces produced by collapsing cavitation bubbles are also able to penetrate blind holes and recesses that are not disposed in the line of sight of the ultrasonic transducers.

The housing 801 of the maintenance cap 800 defines a chamber in which, in use, cleaning liquid 1001 is held. The housing 801 comprises an opening 802 in its top face as shown in FIG. 8. The opening 802 in the housing 801 is an elongated rectangle corresponding approximately with the shape of the intermediate electrode 10. When the housing 801 is engaged with a printhead 100, the position of opening 802 on the top face of the housing 801 corresponds to the location to an opening 106 in the intermediate electrode 103, so as to provide a fluid path between cleaning liquid 1001 in the housing chamber and the internal volume of the printhead.

In order that a seal may be formed between the housing 801 and the printhead 100, the size of the opening 802 is less than the size of the intermediate electrode 103 of the printhead 100. Specifically, the length of the opening 802 in the housing 801 is less than the length of the intermediate electrode 103, and the height of the opening 802 in the housing 801 is less than the height of the intermediate electrode 103. In order that the ultrasonic waves may be supplied across the entire opening 106 in the intermediate electrode 103, the length of the opening 802 in the housing 801 is greater than the length of the opening 106 in the intermediate electrode 103.

In a preferred embodiment, the housing comprises thick walls at its bottom surface for efficiently conducting ultrasonic energy into a liquid and for spreading the ultrasound waves evenly throughout a liquid in the chamber of the housing. The chamber of the housing becomes progressively narrower towards the top of the housing in order to direct a large proportion of the ultrasonic power towards the opening in the top wall.

In this example the housing 801 is fabricated from 2 mm thick steel or a similar rigid material. In this example the housing 801 has at least as great a width as the intermediate electrode of the printhead. In examples where the maintenance cap is suitable for use with a printing module comprising more than one printhead 100, such as the maintenance cap shown in FIG. 19, there may be more than one opening 802 in the housing 801.

The cleaning or rinse liquid 1001 is composed largely of the carrier liquid used in the printing ink. Preferably, the cleaning or rinse liquid comprises an aliphatic hydrocarbon, such as a $C_1$-$C_{20}$ alkane. More preferably, it is a branched $C_1$-$C_{20}$ alkane. Such liquids include Isopar G from ExxonMobil, hexane, cyclohexane and iso-decane.

The rinse liquid may further comprise a dispersant. The dispersant is usually a material such as a polymer, an oligomer or a surfactant, which is added to the rinse liquid in order to improve the dispersability of ink deposits. Examples of dispersants include Solsperse S17000 made by Lubrizol and Colorburst 2155.

The rinse liquid may further comprise a charge control agent. Preferably, the charge control agent is a metal salt or a polar solvent. Examples include "Nuxtra Zirconium 6%" from Huls America Inc. and "Octa-Soligen Zirconium 6" from OMG.

A compliant face-seal 803, made from a material that is compatible with the cleaning liquid, is disposed around the opening 802 in the housing 801. When the maintenance cap 800 and the printhead 100 are engaged, the face-seal 803 is positioned between the housing 801 and the printhead 100 and forms a liquid tight seal. Thus, the face-seal 803 forms the side wall of a small volume, having a first base formed by the housing 801 and a top formed by the intermediate electrode 103. The small volume comprises two openings: the opening 802 in the housing 801 and the opening 106 in the intermediate electrode 103. In this way, the maintenance cap 800 and the printhead 100 cooperate to form a larger enclosed cleaning volume when engaged, the larger enclosed cleaning volume comprising the chamber of the maintenance cap housing 801, the small volume between the printhead 100 and the maintenance cap 800, and an internal volume of the printhead 100.

With reference to FIG. 4, the internal volume of the printhead 100 that is filled with cleaning liquid comprises at least the volume surrounding the ejection locations 403 and the cavity 402 and may further include the enclosed spaces 405 defined by the V-shaped cavity 402 in the datum plate 104 and the outer surfaces of the inflow 101 and outflow 102 blocks, and the fluid outlets 207 into these spaces 405. With reference to FIGS. 5 and 6, the internal volume of the printhead 100 that is filled with cleaning liquid further comprises the ink channels 404, 411 and 412 and may further include the front portions of the inlet manifold 407 and the outlet manifold 409.

As will be understood, if the maintenance cap housing 801 comprises more than one opening 802, there may be more than one face-seal 803, with a separate face-seal 803 for each opening 802 in the maintenance cap housing 801.

A seal plate 804 is used to clamp the face-seal 803 to the housing 801 of the maintenance cap 800.

In this example two ultrasonic transducers 805 are rigidly bonded to the outer surface of the bottom of the maintenance cap housing 801 to enable acoustic energy to propagate through the housing 801 into the cleaning liquid 1001 in the cap. The ultrasonic transducers 805 may be piezo-electric transducers or another type of transducer capable of generating ultrasonic waves in a liquid contained in the housing 801. An example of suitable transducers and drive electronics for the maintenance cap 800 are 40 kHz 50 W transducers having radiating surfaces of approximately 12 $cm^2$ and a Generator Board, both available from EJ Electronics Ltd (www.ejelectronics.co.uk).

In commercial general-purpose ultrasound baths, transducer operating frequencies of 30-33 kHz are commonly used, offering an effective but quite aggressive cleaning action. Higher frequencies, such as 40 kHz, are less aggressive but more penetrating and, therefore, more suitable for delicate objects and complex shapes and as such are more commonly used for the cleaning of jewelry. In tests performed to examine the effect of commercial ultrasonic baths on cleaning electrostatic printheads, it was found that ultrasonic baths operating at 30-33 kHz had the potential to cause damage to printheads.

In the present application ultrasonic transducers have been found to be most effective when generating acoustic waves of frequency 38 kHz to 40 kHz, which were able to penetrate the slot 106 in the intermediate electrode 103.

Acoustic waves of this frequency were found effective in cleaning the ejection locations 403 and intermediate electrode 103 without causing damage to them. While this frequency range may provide optimal usage conditions in the present example, acoustic waves with frequencies between 20 kHz to 100 kHz are potentially suitable for use with other examples of maintenance caps, somewhat dependent upon their specific design.

Slightly modulating the frequencies of the ultrasonic transducer 805 output during use prevents the formation of stationary nodes and anti-nodes of excitation, which would create an uneven power distribution throughout the volume of cleaning liquid 1001. Frequencies may be modulated by sweeping, in which the frequency is modulated in a continuously variable way, or hopping, in which the frequency is switched periodically between fixed values.

In order to ensure cavitation of the cleaning fluid, the ultrasonic transducers are configured to supply ultrasonic energy to the fluid at a power level suitable for causing cavitation. The power level required to cause cavitation at surfaces in liquid is related to the surface area of the vibrating radiating surface of the each transducer and the frequency of the ultrasonic waves. The power intensity required to produce ultrasonic cavitation increases as the frequency of the ultrasonic waves increases. Both the frequency and intensity of ultrasonic waves must be chosen in order to produce cavitation of the cleaning fluid without the use of a power intensity sufficient to damage the printhead.

For ultrasonic waves having a frequency range of between 20 kHz-100 kHz, the power level of each transducer is, preferably, between 0.1 and 10 $W/cm^2$ and, more preferably, between 1 and 10 $W/cm^2$.

In a preferred embodiment of the invention, each transducer has a radiating surface of approximately 12 $cm^2$ and provides ultrasonic waves in the chamber with an intensity of up to 50 W. Preferably, in use, each transducer is driven at a power of between 30 and 50 W.

Printheads 100 of the type suitable for use with the maintenance cap 800 are elongated structures. The power supplied to the printhead 100 should be substantially uniform along its length in order to achieve a consistent cleaning process without damaging any of its elements. The transducers 805 are generally of circular cross section normal to the primary direction of acoustic wave propagation. As such, since the opening 802 is generally elongate, two transducers are arranged side-by-side, typically 60 mm apart, in the direction of elongation to provide a relatively homogeneous distribution of acoustic waves along the opening. These are positioned symmetrically with respect to the printhead such that the centre point between the transducers is aligned with the centre of the printhead 100.

Whilst two transducers are used in the present example, the number of transducers which are suitable for use in other examples is dependent upon the shape, size and power of each transducer and the geometry of the maintenance cap and printhead. This may be effected by one, two or more transducers provided in one, two or three dimensional arrays or other shaped arrangements as the case may be.

Returning now to the housing 801 of the maintenance cap, this comprises two fluid ports, each of which is attached to a fluid connector 806 and suitable for receiving or draining cleaning liquid 1001. A first of the fluid ports is used both to receive cleaning liquid 1001 from a cleaning liquid source and to drain cleaning liquid 1001 into a cleaning liquid drain. A second of the fluid ports is connected to a fill level control device 1007 (for which see FIG. 11), which is used to control the level of the cleaning liquid 1001 in the larger enclosed volume formed by the printhead 100 and maintenance cap housing 801 by allowing excess cleaning liquid 1001 to drain from the chamber when the maintenance cap 800 has been filled to a desired fill level 1002.

Whilst the use of the second fluid port provides a convenient means of controlling the fill level, in other examples a single port and connector could be used to provide this dual functionality. Alternatively a single port and connector could be used in circumstances where the fill level is effected using other approaches (such as using a controlled volume of liquid), or indeed where no fill level monitoring or control is needed. Of course three or more fluid ports with corresponding connectors could also be used where convenient to do so.

Figure 9:
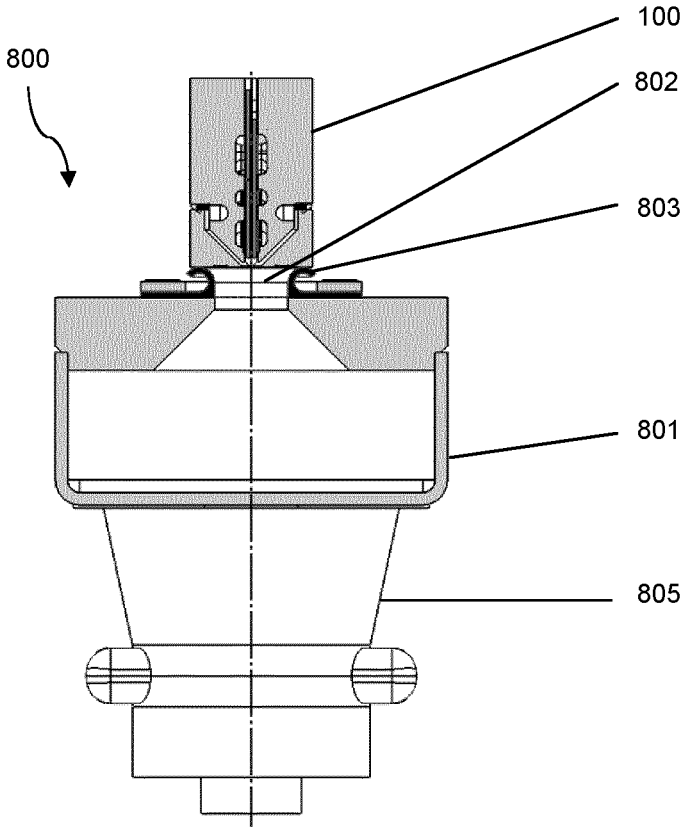
FIG. 9 is a sectional view of the ultrasonic maintenance cap engaged with a printhead.

In FIG. 9, the maintenance cap 800 is illustrated in engagement with the printhead 100. The maintenance cap housing 801, the face-seal 803, and the printhead 100 cooperate to form an enclosed cleaning volume which may be filled with a cleaning liquid 1001. It is to be understood that the printhead 100 is connected to the printing apparatus when the maintenance cap 800 is engaged, and that the ultrasonic cleaning process may be performed in-situ, without requiring removal of the printhead 100 or of the intermediate electrode 103 from the printhead.

The printhead 100 is shown as being directed downwards. This allows the level of cleaning liquid 1001 to engulf the printing region of the printhead 100 consistently, as the intermediate electrode 103 and the ejection locations 403 lie in respective horizontal planes. Thus, a certain height of cleaning liquid 1001 will immerse the entire intermediate electrode 103, and a slightly greater height of cleaning liquid 1001 will immerse all of the ejection locations 403.

Figure 10:
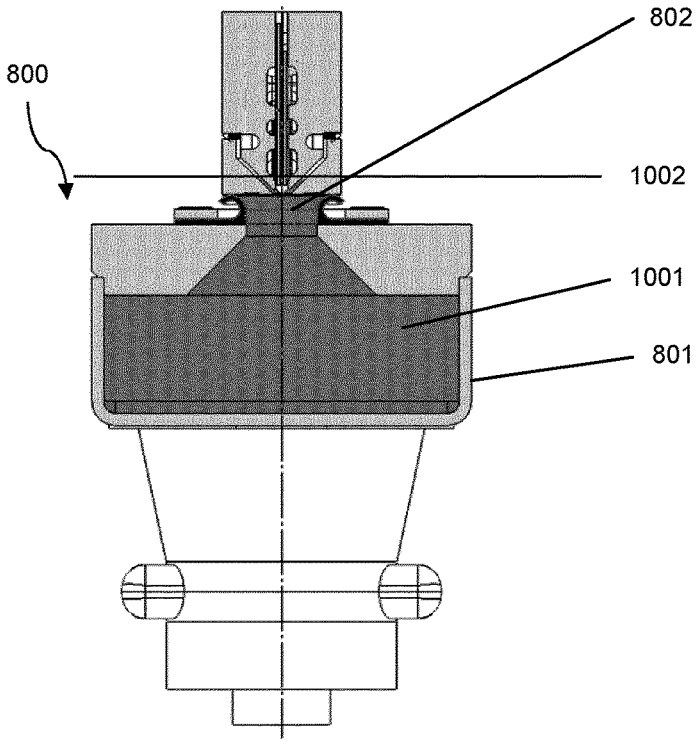
FIG. 10 is a sectional view of the ultrasonic maintenance cap engaged with a printhead where the maintenance cap and printhead have been filled with a cleaning liquid.

In FIG. 10, the maintenance cap 800 is shown as engaged with the printhead and has been provided with cleaning liquid 1001. The cleaning liquid 1001 has filled the chamber in the maintenance cap housing 801, extended through the opening 802, and extended through the opening in the intermediate electrode 103 into the printhead 100 up to the fill level 1002. The intermediate electrode 103 and the ejection locations 403 are immersed in the cleaning liquid 1001.

After the cleaning liquid has filled the chamber and an internal volume of the printhead such that the ejection locations 403 are immersed, supply of cleaning liquid to the maintenance cap 800 is stopped, allowing liquid in the chamber and the printhead to settle, thus providing a medium through which ultrasonic waves may propagate without disturbance due to turbulence.

Ultrasonic waves that are generated by the ultrasonic transducers 805 will propagate throughout the cleaning liquid 1001 and form cavitation bubbles across the internal surfaces of the cleaning volume. The forces produced by the collapsing bubbles act to remove unwanted matter from surfaces including the ejection region of the printhead 100.

Figure 10A:
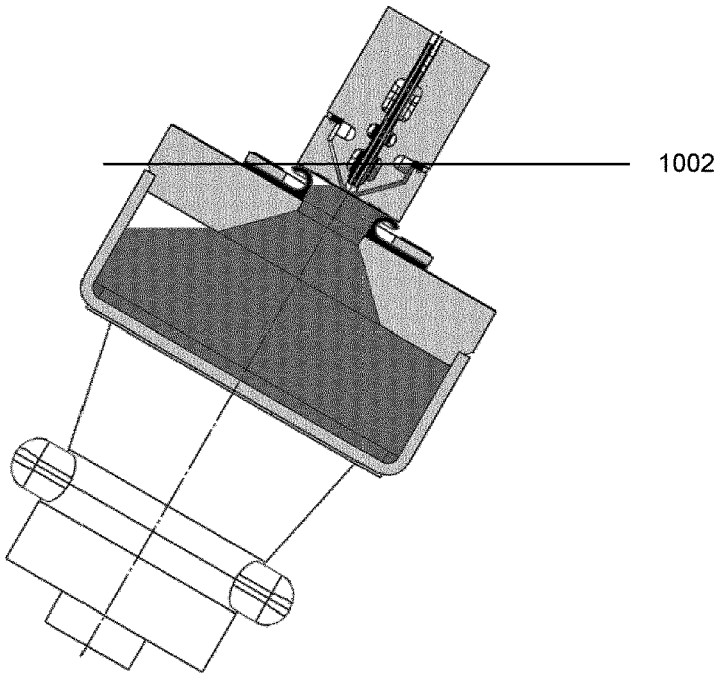
FIG. 10*a* is the same sectional view as FIG. 10, showing the level of the cleaning liquid in the case where the printhead is in a tilted orientation.

In some machine configurations it may be preferable for the printhead to be oriented such that the ejection locations are facing downwards and tilted rather than purely downwards, albeit with the line of ejectors oriented in a horizontal line so that there is an equal hydrostatic pressure for each ejector of the printhead in operation. In this case filling with cleaning liquid to a certain predetermined level will immerse all of the ejection locations 403 and the inside surface of the intermediate electrode which faces the ejection locations, as well as the majority of the outside face of the intermediate electrode (FIG. 10*a*). In this case there is potentially a small region of trapped air at the highest edge of the outside face of the intermediate electrode adjacent the location of the face-seal of the cap; this is acceptable as this region is far from the ejection region and is therefore not required to be cleaned by an ultrasonic cleaning operation.

It will be appreciated that for printhead orientations that are downwards and tilted, modifications within the scope of the invention may be made to the detail design of the maintenance cap to optimise filling and draining in the particular orientation chosen.

Figure 11:
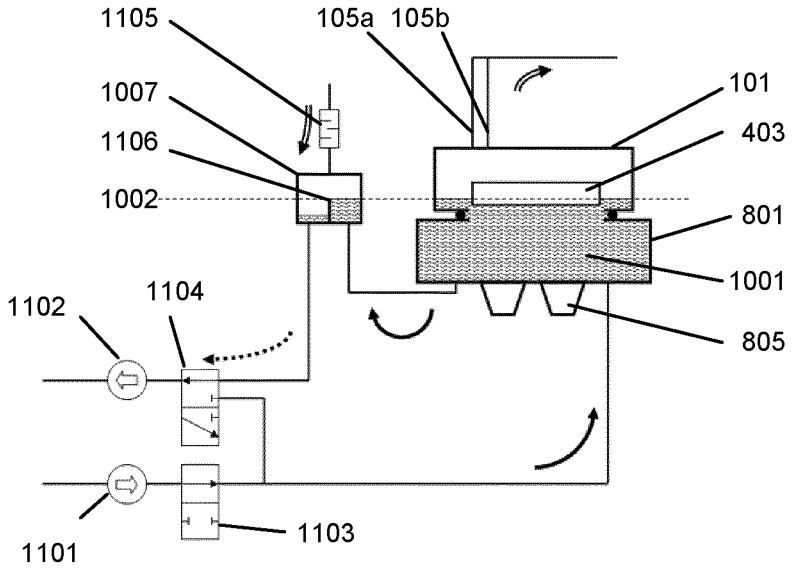
FIG. 11 is a schematic view of a system including a maintenance cap and a fill level device during a cleaning liquid filling process.

In FIG. 11, the maintenance cap 800 forms part of a system that further comprises a fill level control device 1007. The fill level control device functions to define a maximum fill level 1002 of cleaning liquid in the maintenance cap 800 and printhead 100. Whilst in FIG. 11 the fill level control device 1007 is indicated as being a physically separate component from the maintenance cap, in practice it may be provided as part of the maintenance cap since this assists in controlling the fill height 1002 to be described below.

FIG. 11 provides a schematic view of a cleaning liquid filling process using the maintenance cap 800 and fill level control device 1007. The fill pump 1101 provides cleaning liquid 1001 from a liquid supply. A fill valve 1103 is shown as open, which allows the cleaning liquid 1001 to flow via the first fluid connector 806 into the chamber of the maintenance cap housing 801. The fill level control device 1007 is in fluid communication with the chamber of the maintenance cap housing 801. As the chamber of the maintenance cap housing 801 is filled, a small quantity of cleaning liquid 1001 flows from the second fluid connector 806 into the fill level control device 1007. The cleaning liquid 1001 eventually fills the chamber of the maintenance cap housing 801 and begins to fill the ejection region of the printhead 100. As the cleaning liquid level rises, air from the internal connected volumes of the maintenance cap and printhead is vented via the cleaning fluid passages 401 and inlets 105*a* and 105*b* to atmosphere.

The fill level control device 1007 comprises a closed volume that is kept at atmospheric pressure using a vent 1105 connecting the inside of the fill level control device 1007 to the outside. As the fill level control device 1007 and the chamber of the maintenance cap housing are both at atmospheric pressure and in fluid communication, the level of cleaning liquid 1001 in the fill level control device 1007 is the same as the level of cleaning liquid 1001 in the maintenance cap 800 and printhead 100. The fill level control device 1007 comprises a weir 1106, the top of which is fixed at a desired fill height 1002. When the level of cleaning liquid 1001 exceeds the height of the weir 1106, the liquid flows over the weir 1106 and is removed by a drain pump 1102, which is connected to the fill level control device via the drain valve 1104. Thus, when the cleaning liquid 1001 supplied to the maintenance cap 800 and printhead 100 reaches a certain level 1002, any excess cleaning liquid 1001 supplied will be allowed to flow over the weir 1106 in the liquid level control device 1007 and be removed by the drain pump 1106. To ensure that the cleaning liquid 1001 in the printhead 100 and maintenance cap 800 reaches the correct level 1002, the chamber of the maintenance cap 800 is supplied with slightly more cleaning liquid 1001 than is necessary to fill the maintenance cap 800 and printhead 100 up to the desired fill level 100. Excess cleaning liquid 1001 is then allowed to drain out of the chamber via the fill level control device 1007. The excess cleaning liquid 1001 that overflows the weir 1106 is returned to a cleaning liquid source tank.

Figure 12:
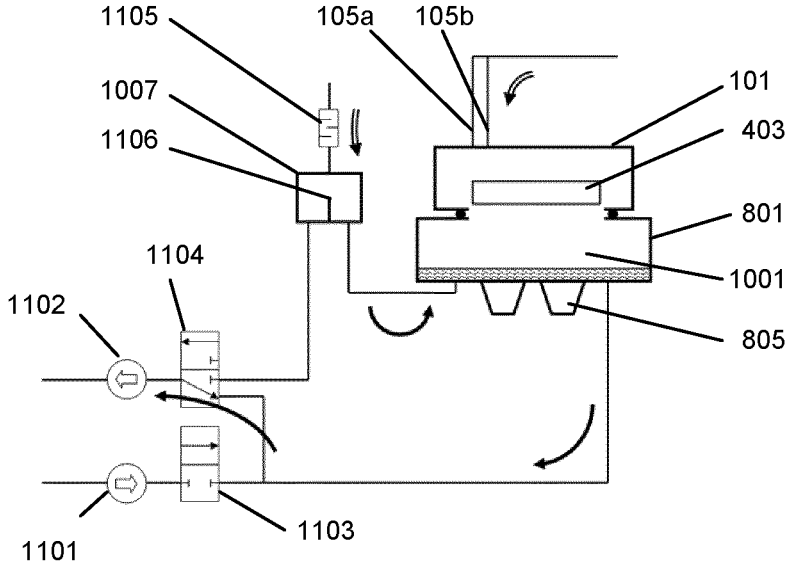
FIG. 12 is a schematic view of the system including a maintenance cap and a fill level device during a cleaning liquid draining process.

FIG. 12 provides a schematic view of a cleaning liquid draining process using the maintenance cap 800 and fill level control device 1007. In contrast to the cleaning liquid filling process, the fill valve 1103 is now closed and the first fluid connector 806 is not in fluid communication with the fill pump 1101. Instead, the first fluid connector 806 is in fluid communication with the drain pump 1102 via the drain valve 1104. The drain valve 1104 no longer provides a fluid path between the fill level control device 1007 and the drain pump 1102.

During the draining process, cleaning liquid 1001 is removed from the chamber in the maintenance cap housing 801 via the first fluid connector 806. Cleaning liquid 1001 in the fill level control device 1007 and the printhead 100 flows first into the chamber in the maintenance cap housing 801 and is then drained via the first fluid connector 806.

After the maintenance cap 800 has been drained, the printhead 100 may then be flushed with cleaning liquid 1001 (using the procedure described in association with FIG. 7) in order to remove unwanted matter that has become dislodged or loosened by the ultrasonic cleaning treatment.

Figure 13:
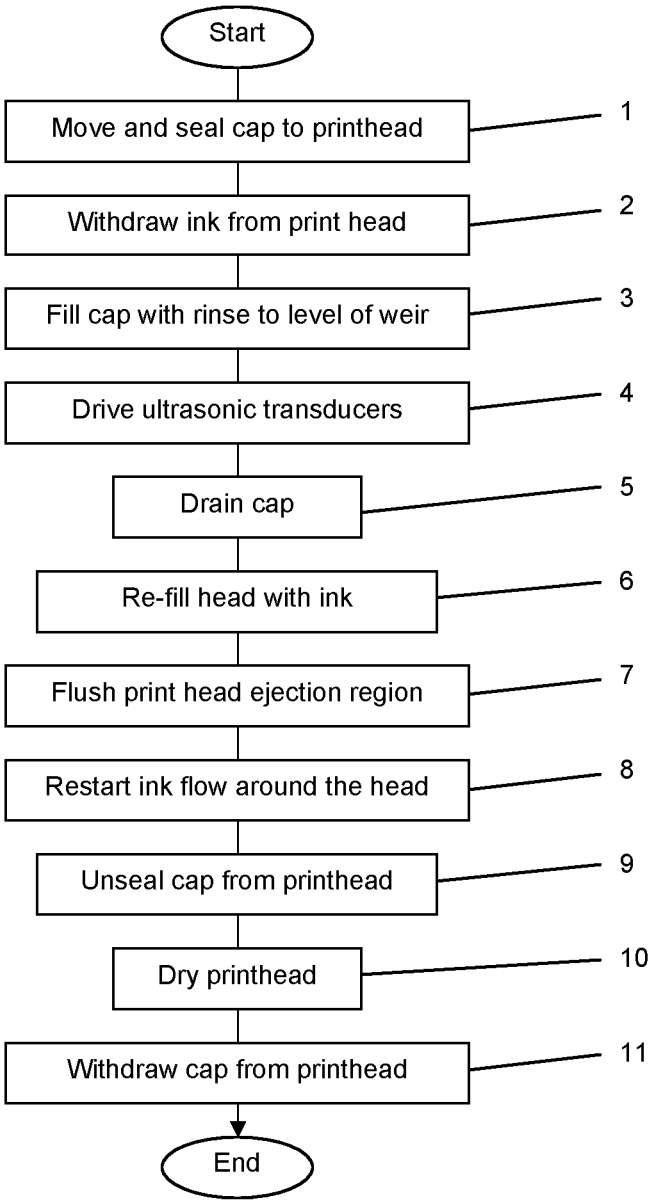
FIG. 13 is a flow chart describing the stages of a cleaning process using an ultrasonic maintenance cap.

The stages of an example of the cleaning process using the ultrasonic maintenance cap 800 are shown in FIG. 13 and are as follows:

1. While the printhead 100 remains engaged to a printing machine, the ultrasonic maintenance cap 800 is brought into engagement with the printhead 100, thus forming a liquid tight seal between the maintenance cap 800 and the printhead face. When in engagement, the maintenance cap is positioned beneath the downward-facing (or downwards and tilted) ejection locations 403.

2. Ink flow around the printhead 100—a constant feature of the printhead 100 during a printing operation, controlled by difference in ink pressures between ink inlet and outlet ports of the printhead 100—is stopped by setting equal pressures at the inlet and outlet ports, at the mid-point of the normal operating pressures. The pressures at the inlet and outlet ports are then lowered in order to withdraw ink from at least the lowermost part of the printhead 100 to be cleaned.

3. The fill pump 1101 starts to supply cleaning liquid 1001 into the chamber of the maintenance cap housing 801. The height of the cleaning liquid 1001 in the housing chamber increases beyond the heights of the housing 801 and the face-seal 803 and into the printhead 100 such that the intermediate electrode 103 and the ejection locations 403 are engulfed in the cleaning liquid 1001. At a predetermined height 1002, cleaning liquid begins to overflow over the weir 1206 of the fill level control device 1007, which is in fluid communication with chamber 801 in the maintenance cap. The height of the cleaning liquid 1001 in the printhead 100 is thus limited to the height of the weir 1206 in the fill level control device 1007. The fill pump 1101 is configured to provide the maintenance cap 800 with slightly more cleaning liquid 1001 than is needed to reach the desired fill level, after which the fill pump 1101 stops providing cleaning liquid 1001 to maintenance cap 800. A small quantity of liquid always flows over the weir 1106 in the fill level control device and is then returned to the cleaning liquid 1001 supply source. Alternatively a sensing device may be used to sense when liquid starts to overflow the weir 1106 and control the fill pump 1101 to stop pumping. When the fill pump 1101 has stopped providing cleaning liquid to the maintenance cap 800, the fill valve 1103 is then closed, preventing cleaning liquid 1001 from draining from the maintenance cap 800 during the cleaning process.

4. The ultrasonic transducers 805 are then driven for a predetermined period, typically between 0.5 and 2 minutes. During this period the ultrasonic transducers are preferably driven in short bursts of between 0.1 and 5 seconds, alternated with short off periods of preferably between 0.1 and 5 seconds. The short off periods allow cavitation bubbles that do not collapse fully (due, for example to the presence of dissolved air in the cleaning liquid) to clear from the cleaning liquid, improving conduction of the ultrasonic waves through the liquid at the start of the subsequent burst of power, thereby increasing the cleaning effectiveness of the method. The transducers 805 are each preferably driven at a frequency of between 38 kHz and 40 kHz at a power of between 30 W and 50 W. The frequency may be modulated using sweeping or hopping patterns. Ultrasonic acoustic waves are generated in the cleaning liquid 1001 and propagate towards the ejection region of the printheads 100. Cavitation bubbles are formed in the cleaning liquid 1001. Large forces are produced when the cavitation bubbles collapse, causing deposits of unwanted matter around the intermediate electrode 103 and the ejection locations 403 to be dislodged or weakened.

5. The drain valve 1104 then opens a connection between the drain pump 1102 and the first fluid connector 806 of the maintenance cap housing 801. Cleaning liquid 1001 drains out of the printhead 100, the fill level control device 1007, and the chamber in the maintenance housing 801 via the first fluid connection port 806. Dislodged matter is carried out of the printhead 100 and maintenance cap by the draining liquid.

6. The printhead is re-filled with ink by raising the ink pressures to bring the ink forwards to the tips again. Some ink may be expelled from the tips to ensure the ink channels of the head are adequately filled with ink. Any expelled ink is removed from the printhead by the following flushing step.

7. Cleaning liquid, of the same type as is used in the ultrasonic cap, is then supplied to the fluid inlets 105*a* and 105*b*, which were previously vented to atmosphere via an external control valve. The cleaning liquid passes through the upper and lower fluid manifolds 204, 205, where it is distributed via fluid connectors 206 to eight passages 401 spaced evenly across the width of the printhead 100: four on the upper side and four on the lower side. It emerges from fluid outlets 207 into the cavity 402 in the datum plate 104 near the front of the printhead 100 and within which the ejection tips 410 and the inner face of the intermediate electrode 103 are located. The cleaning liquid is periodically directed through the fluid passages 401 in short bursts, controlled via an external control valve. Typical burst times are 2 seconds on, 1 second off, for 9 seconds. Cleaning liquid flows from the cavity 402 through the open slot in the centre of the intermediate electrode 103 into the maintenance cap 800 from where it is drained.

8. Ink flow around the printhead tips is restarted by setting a pressure difference between the ink inlet 220 and the ink outlet 221 of the printhead.

9 The maintenance cap is unsealed from the face of the printhead but not withdrawn. This increases the ventilation of the printhead during the following drying step.

10. Air is then supplied to the fluid inlets 105*a* and 105*b* via an external control valve to dry the faces of the passages 405, the cavity 402 and the intermediate electrode 106 of residual cleaning liquid. Air flows through the spaces 405 and the cavity 402 and out of the slot in the face of the intermediate electrode from where it vents to atmosphere past the disengaged maintenance cap seal.

11. The ultrasonic maintenance cap 800 is then withdrawn completely from the printhead 100. As the cap is withdrawn, a wiper 1530 attached to the printhead engagement section of the cap is drawn across the face of the printhead removing any residual liquid from the face of the printhead.

End

It is understood that the sequence described above is one example of possible sequences that incorporate a period of ultrasonic cleaning into the maintenance of the printhead or printheads, and that details of the sequence may vary within the scope of the present invention.

The descriptions above describe filling of the maintenance cap chamber and printhead cavity 402 with rinse/cleaning liquid via a fluid connection 806 in the cap. Other methods of filling are possible within the scope of the invention, including utilising the cleaning fluid inlets 105*a* and 105*b* of the printhead to supply rinse/cleaning liquid to the maintenance cap chamber and printhead cavity 402 through the printhead.

Figure 14:
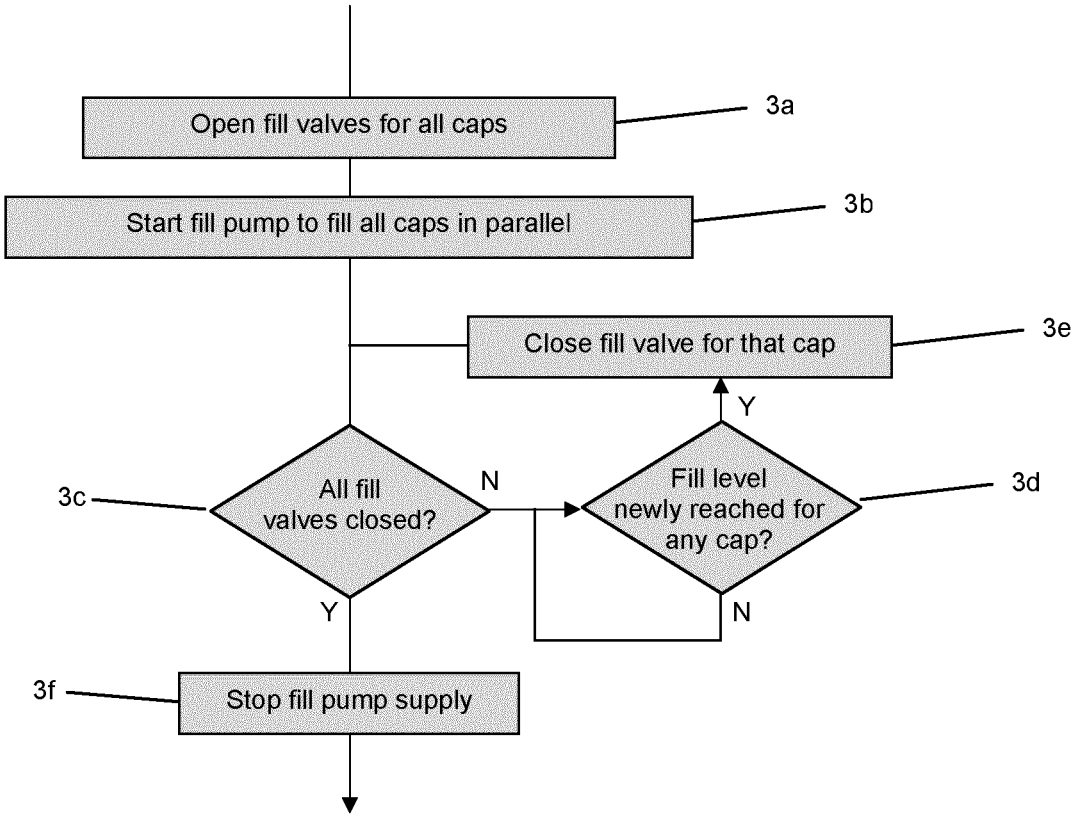
FIG. 14 is a flow chart describing a process for filling multiple heads of a maintenance cap from the same cleaning liquid supply.

The stages of a filling process for multiple ultrasonic maintenance caps for use with multiple respective printheads is shown in FIG. 14.

For multiple maintenance caps (which may be at different heights on a printing machine) to be supplied with cleaning liquid in parallel from a single fill pump, it is beneficial to have individual fill valves 1103 between the pump 1101 and each respective maintenance cap 800. Once the first cap is filled, its associated fill valve is closed while the pump continues to supply cleaning liquid to the other caps until, one by one, the caps are all filled and all of the fill valves are closed.

To ensure each chamber is properly filled without using unnecessary cleaning liquid, a detection system for the level of the cleaning liquid in each chamber can be employed. This may comprise a liquid level sensor disposed in the fill level control device 1007 to sense when the liquid level is at or near to the height of the weir; it may alternatively comprise a liquid flow sensor disposed in the outflow from the fill level control device to sense when liquid overflows the weir having reached the desired fill level set by the weir.

Alternatively this function can be performed by the local printhead ink pressure control apparatus (the Local Ink Feed or LIF for short). During the chamber filling operation, a LIF can be suitably configured to sense when the cleaning liquid level touches the ejection tips of the printhead. One way in which it may do this is by applying suction to the ink feed tubes connecting the LIF to the head, and monitoring the air pressure in the LIF using an existing sensor (which is used in the closed-loop control of ink feed pressures when the head is primed with ink). When the cleaning liquid immerses the tips, a drop in air pressure at the LIF sensor occurs, which is used to signal to the controller of the pump and valves to close the fill valve for the respective chamber.

It will be appreciated that many suitable possibilities exist for detection of the fill level and may be successfully employed in the present invention.

The stages of filling multiple maintenance caps 800 are as follows:

3a The fill valves 1103 for all caps are opened.

3b The fill pump 1101 provides all caps with cleaning liquid 1001.

An iterative decision loop is then initiated, to be repeated until all fill valves are closed.

The iterative loop comprises the following steps:

3c Determine whether all the fill valves are closed. If all the fill valves are closed, proceed to step 3f. If any fill valves remain open continue the decision loop to step 3d.

When the loop is initiated, all the fill valves will be open as required by step 3a.

3d The fill level is monitored for each cap. If the fill level is detected as newly reaching the desired level, proceed to step 3e. If the desired fill level has not been reached, continue to monitor the fill level.

3e After the fill level is detected as newly reaching the desired level in a given cap, the fill valve associated with that cap is closed. Step 3c is then repeated.

3f When all of the fill valves have been closed, the iterative decision loop is aborted and the supply of cleaning liquid from the fill pump is stopped.

Figure 15:
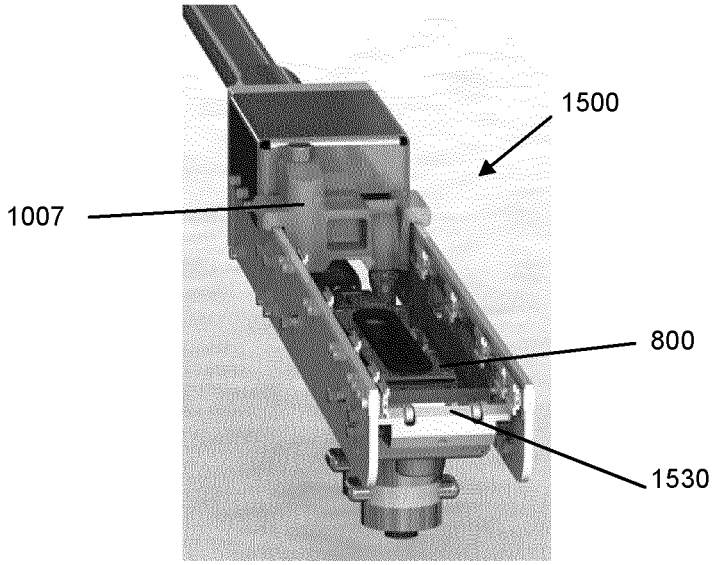
FIGS. 15 and 15*a* are perspective views of a maintenance cap comprising a weir/vent component and a printhead engaging section.
Figure 15A:
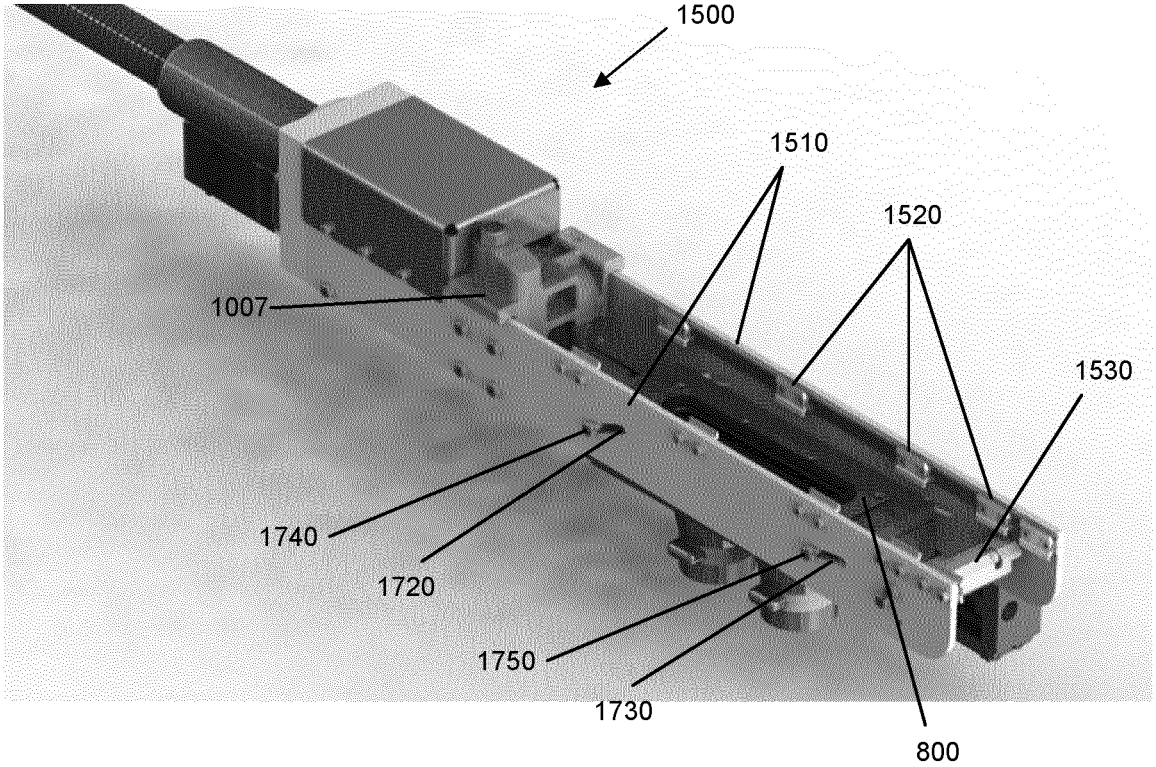

Some embodiments of the maintenance cap 800 comprise a printhead engaging section 1500, as shown in FIG. 15 and FIG. 15*a*, to allow the maintenance cap 800 to be attached precisely and securely to the printhead 100 during use.

The printhead engaging section 1500 comprises upstanding side walls 1510, which extend beyond the opening 802 of the maintenance cap 800 so as to partially surround the printhead 100 when engaged with the maintenance cap 800. The maintenance cap 800 comprises a plurality of bearings 1740,1750 which are disposed within a plurality of bearing slots 1720, 1730 in the printhead engaging section 1500. The printhead engaging section 1500 and the maintenance cap 800 may move a small distance relative to one another as constrained by the bearings 1740,1750 and the bearing slots 1720,1730.

Figure 16:
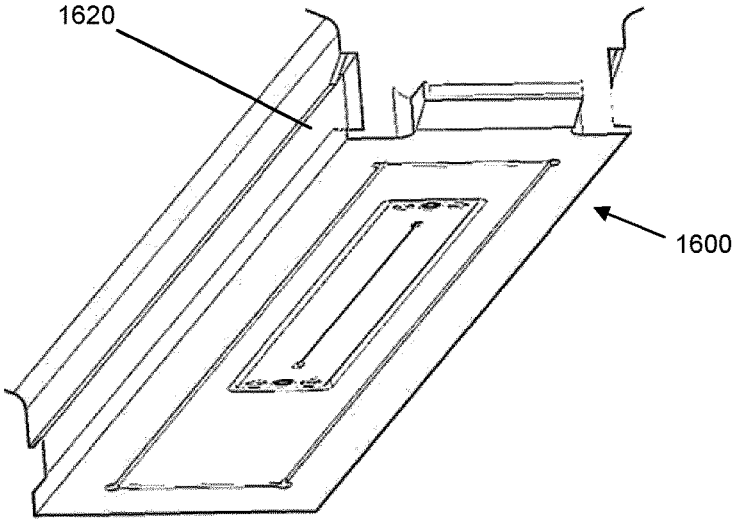
FIG. 16 is a perspective view of an outer casing of a printhead module with which the maintenance cap engages.

The side walls 1510 include linear key way bearings 1520. The linear key way bearings 1520 are designed to engage with a corresponding profile 1620, shown in FIG. 16, on a printhead module outer casing 1600.

In some embodiments, the side walls 1510 could be replaced with, or used together with, other means of mounting the cap 800 on the printhead 100. This is especially true if multiple printheads are provided and the same cap is used to cover more than one of the printheads at the same time.

A maintenance cap 800 comprising a printhead engaging section 1500 is brought into engagement with a printhead module outer casing 1600 in a number of steps. The maintenance cap 800 is first moved into a position facing the printhead by moving the maintenance cap 800 laterally with respect to printhead 100, the linear key way bearings 1520 moving along the corresponding profile 1620 of the printhead module outer casing 1600. This movement is typically driven by a motorised linear stage (not shown). The provision of the linear key way bearings 1520 and the corresponding profile 1620 of the printhead module outer casing 1600 constrains the relative positions of the printhead 100 and the maintenance cap 800 to those allowed by the profile of the printhead module outer casing 1600.

During the lateral movement, the maintenance cap 800 is not clamped against the face of the printhead 100, but is free to move across the face of the printhead 100 along the path defined by the linear key way bearings 1520 and the profile of the printhead module outer casing 1600.

Figure 17:
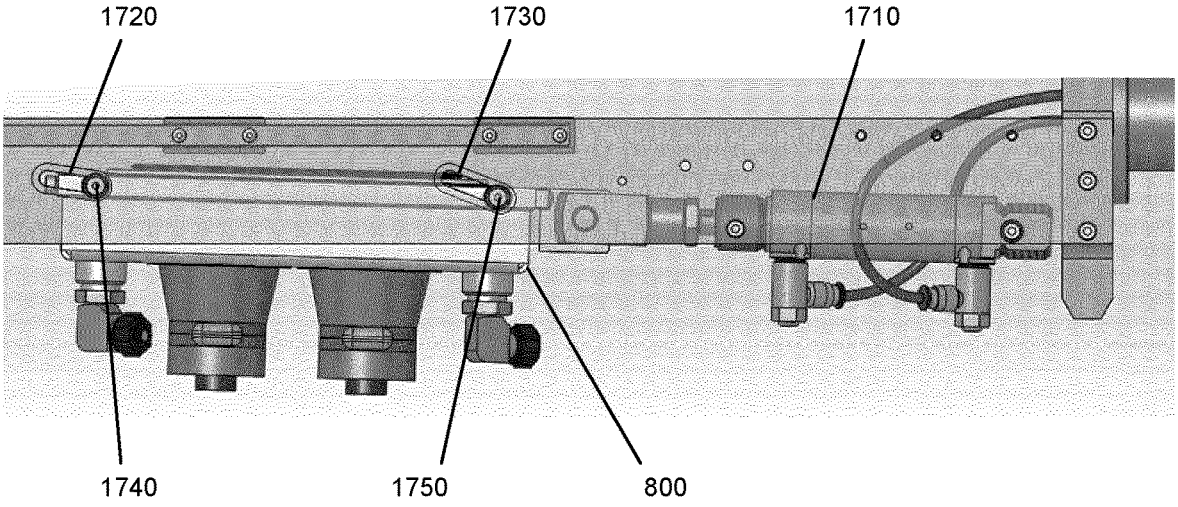
FIG. 17 is a view of a maintenance cap engagement mechanism.

Once in position over the face of the printhead, the maintenance cap 800 is clamped against the face of the printhead 100 in a second movement driven by a pneumatic actuator 1710, shown in FIG. 17. This second movement is a swiping motion to ensure loose material or debris is wiped from the sealing surface during engagement. The motion is guided by the bearings, 1740 and 1750, of the maintenance cap 800 and the bearing slots, 1720 and 1730, in the printhead engaging section 1500. The first 1720 and second 1730 bearing slots are of different angles from front to back (see FIG. 17), along which respective bearings 1740 and 1750 move, thus ensuring that the seal 803 is gradually introduced and compressed whilst moving across the printhead 100 face (this arrangement of bearings exists on both sides of the maintenance cap 800). The pneumatic actuator 1710 is driven by compressed air and a metered outflow restriction is used for speed control of the engagement movement. A final stroke pneumatic cushion is used to ease the seal 803 into its final compressed position.

Also shown in FIGS. 15 and 15*a* is an embodiment of a maintenance cap comprising a fill level control device 1007 which in this embodiment is mounted between the side walls 1510 of the engaging section of the cap.

Figure 18:
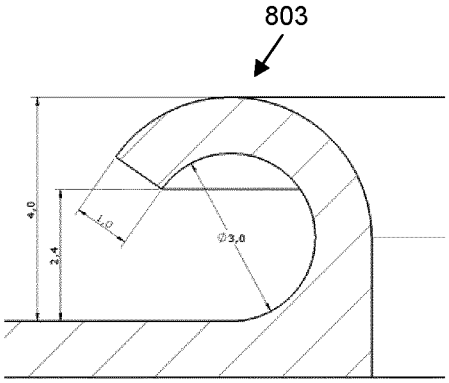
FIG. 18 is a cross-section view of a seal for sealing the maintenance cap to the printhead.

FIG. 18 shows an example of a seal 803 suitable for use with the present invention. The seal 803 itself is of open hollow form construction, comprising a curved raised section surrounding an air void. The seal 803 is formed of a compressible material such as fluoroelastomer (trade name Viton from DuPont) with a shore hardness of 70 A and which is compatible with Isopar-based cleaning liquid. The seal 803 is designed such that the curved raised section can collapse into the air void before the cushioned end stroke of the pneumatic powered actuation compresses the compressible material itself. This helps to achieve a liquid tight seal.

Figure 19:
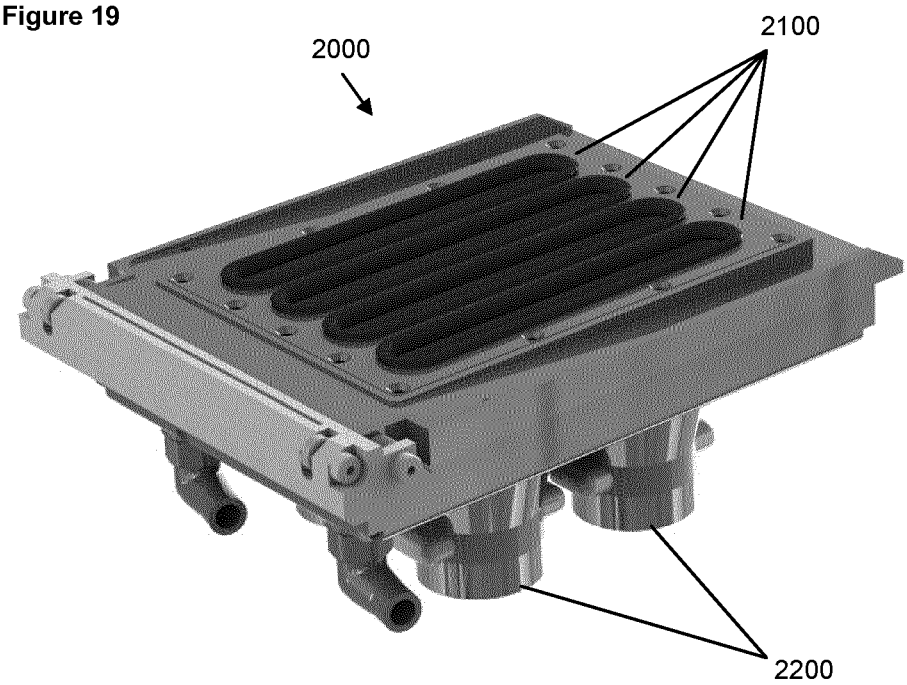
FIG. 19 is a perspective view of a maintenance cap for use with a four-printhead printing module.

FIG. 19 shows an ultrasonic maintenance cap 2000 suitable for a printing module comprising multiple printheads. The housing of the maintenance cap defines four chambers. Each chamber comprises an opening 2100 and face-seal for engagement with a printhead. The ultrasonic maintenance cap 2000 comprises four ultrasonic transducers 2200 bonded to the housing for generating ultrasonic waves in cleaning liquid in the housing. Variations on this design include: a common chamber for all four printheads with four individual openings and face-seals for engagement with respective printheads; two chambers, at least one of which is common to two or more printheads.

The invention claimed is:

1. A maintenance cap for attachment to at least part of a printhead, the maintenance cap comprising:

a housing defining at least one chamber for receiving a liquid, the housing comprising:

at least one opening providing a path for the liquid to pass from the chamber into a portion of the printhead when the maintenance cap is engaged with the printhead; and a seal disposed around the at least one opening for engagement with the printhead; and at least one transducer coupled to the housing for generating ultrasound acoustic waves in the liquid contained in the chamber and printhead, thereby cleaning the printhead as a result of forces produced by cavitation of the liquid, and wherein the at least one transducer is configured to generate acoustic waves having frequencies between 20 kHz and 100 kHz.

2. The maintenance cap of claim 1, wherein the at least one opening is elongate and has a length greater than that of an opening in the face of the printhead.

3. The maintenance cap of claim 1, wherein the seal disposed around the at least one opening is a compliant face-seal for engagement with the face of the printhead.

4. The maintenance cap of claim 1, wherein the housing comprises a fluid port for receiving liquid from a liquid supply disposed separately from the maintenance cap.

5. The maintenance cap of claim 1, wherein the at least one transducer is configured to generate acoustic waves with frequencies between 30 kHz and 50 kHz.

6. The maintenance cap of claim 1, wherein the at least one transducer is configured to provide acoustic waves to the chamber at an intensity of between 0.1 and 10 W/cm$^2$.

7. The maintenance cap of claim 1, wherein the at least one transducer is coupled to the housing on a surface opposite to the at least one opening.

8. The maintenance cap of claim 1, comprising a plurality of transducers arranged parallel to an elongate axis of the at least one opening in the housing.

9. The maintenance cap of claim 1, wherein the printhead is an electrostatic printhead comprising an inner volume in which ejection locations of the printhead are disposed and further comprising a face with an opening slot that provides a path between the inner volume and the outside of the printhead.

10. The maintenance cap of claim 1, wherein the housing comprises a common chamber which comprises at least one opening providing at least one respective path for the liquid to pass from the chamber into a portion of at least one respective printhead when the chamber is engaged with the at least one respective printhead.

11. The maintenance cap of claim 1, wherein the housing defines a plurality of chambers, each of which is isolated from the other chambers; wherein each chamber comprises an opening providing a path for the liquid to pass from the chamber into a portion of a printhead when the chamber is engaged with the printhead.

12. A system comprising the maintenance cap of claim 1, further comprising a fill level control device, the fill level control device being in fluid communication with the at least one chamber and configured to control a maximum equilibrium height for a liquid in the at least one chamber, wherein the fill level control device is configured such that the maximum equilibrium height of the liquid is greater than the height of the opening of the housing.

13. The system of claim 12, wherein the fill level control device comprises a weir, wherein the height of the top of the weir limits the maximum equilibrium height of the liquid in a cleaning volume defined by the at least one chamber and a printhead with which the chamber is engaged.

14. A system comprising the maintenance cap of claim 1, further comprising a level detection system for monitoring the height of the liquid in the at least one chamber and a printhead with which the chamber is engaged.

15. A method of cleaning a printhead, the method comprising:

forming a seal between a maintenance cap and a printhead by bringing the maintenance cap into engagement with the printhead;

immersing the ejection region of the printhead in a liquid by supplying the liquid into a chamber defined by the maintenance cap;

and cleaning the ejection region of the printhead by generating ultrasound acoustic waves having frequencies between 20 kHz and 100 kHz in the liquid contained in the chamber and printhead, thereby cleaning the ejection region of the printhead as a result of forces produced by cavitation of the liquid.

16. The method of claim 15, comprising:

stopping the supply of liquid into the chamber defined by the maintenance cap at a time when the ejection region of the printhead is immersed in the liquid.

17. The method of claim 15, wherein the step of forming a seal between the maintenance cap and the printhead defines a cleaning volume, wherein the cleaning volume is formed from an interconnected volume comprising the combination of at least a first volume within the maintenance cap and a second volume which is an internal volume within the printhead and wherein the step of immersing the ejection region comprises filling the cleaning volume with the liquid.

18. The method of claim 15, wherein the liquid comprises the same liquid as the carrier liquid for the ink used in the printhead.

19. The method of claim 15, wherein the maintenance cap comprises:

a housing defining at least one chamber for receiving a liquid, the housing comprising:

at least one opening providing a path for the liquid to pass from the chamber into a portion of the printhead when the maintenance cap is engaged with the printhead; and a seal disposed around the at least one opening for engagement with the printhead; and at least one transducer coupled to the housing for generating ultrasound acoustic waves in the liquid contained in the chamber and printhead, thereby cleaning the printhead as a result of forces produced by cavitation of the liquid, and wherein the at least one transducer is configured to generate acoustic waves having frequencies between 20 kHz and 100 kHz.

20. The system of claim 12, further comprising a level detection system for monitoring the height of the liquid in the at least one chamber and a printhead with which the chamber is engaged.

* * * * *